United States Patent [19]

Main et al.

[11] 4,128,025

[45] Dec. 5, 1978

[54] BOLT STARTING DEVICE

[76] Inventors: Harvey M. Main, 820 E. Grove, Dewey, Okla. 74029; Doug Main, 12954 E. 32nd, Tulsa, Okla. 74134

[21] Appl. No.: 822,749

[22] Filed: Aug. 8, 1977

[51] Int. Cl.[2] ..... B25B 13/00

[52] U.S. Cl. ..... 81/58.1; 81/57.29; 81/63

[58] Field of Search ..... 81/58.1, 63, 57.29

[56] References Cited

U.S. PATENT DOCUMENTS

| | | | |
|---|---|---|---|
| 633,880 | 9/1899 | Miller | 81/63 |
| 2,701,490 | 2/1955 | Griparis | 81/58.1 |
| 2,703,030 | 3/1955 | Marvin | 81/58.1 |
| 3,650,165 | 3/1972 | Wolfe | 81/58.1 |
| 3,659,484 | 5/1972 | Scheller | 81/63 |
| 3,707,893 | 1/1973 | Hotman | 81/58.1 |

*Primary Examiner*—James L. Jones, Jr.
*Attorney, Agent, or Firm*—Head, Johnson & Chafin

[57] ABSTRACT

An improvement in a ratcheting socket wrench wherein an elongated shaft is journalled in the handle and is provided with a knob at the outer end of the handle. The shaft is also reciprocally disposed in the handle where in one position it can be rotated thereby rotating the drive stud for starting or removing loose bolts and the like and in a second position it may be rotated to engage the ratcheting device for drive in either direction.

6 Claims, 8 Drawing Figures

BOLT STARTING DEVICE

BACKGROUND OF THE INVENTION

1. Field of the Invention

The present invention relates to improvements in a ratcheting wrench and more particularly, but not by way of limitation, to a feature for disengagement of the ratcheting action and remote turning of the bolt or nut for starting or removing loose bolts and the like and engaging the ratchet action for driving in either direction from the end of the handle.

2. Prior Art

In the ordinary use of a ratcheting socket wrench, it is often required that the wrench be removed from hard to get to places in order to change the direction of the drive stud. This is because the direction switch is normally located on the drive head opposite the drive stud.

Further, there is the ever present problem associated with using a ratchet wrench when the bolt or nut is loose. This often occurs when attempting to start a bolt or in loosening a bolt after it has been broken loose. In most cases, the ratchet action is so tight that it will not operate when the bolt is loose.

Several devices have been designed to overcome the problem of rotating loose bolts as evidenced by the patents to McLean, U.S. Pat. No. 735,134 issued in 1903 and the patent to Marvin, U.S. Pat. No. 2,703,030 issued in 1955, both of which teach the use of a rotating shaft carried by wrench handle and engageable with a gear at the drive stud. However, it is noted that neither of the patents provide the mechanism to center the ratchet pawl during finger tightening or loosening operations.

Further, the date span of the patents indicate how long the problem has been around but the absence of such tools on the market are evidenced that the designs have not been feasible to construct. Neither of the said patents address the problem of convenient changing of direction of the ratchet action.

SUMMARY OF THE INVENTION

The present invention is particularly designed and constructed to provide a compact and efficient ratchet wrench which, by the use of a rotatable shaft carried by the handle, tightening and loosening already loose bolts, nuts and the like may be accomplished while the same shaft is utilized to change ratchet directions.

The wrench generally comprises a typical ratchet wrench head having a rotatable drive stud mounted therein and an elongated handle member secured to or made as an integral part of the head. The back of the drive stud is provided with a circular plate having its plane perpendicular to the rotational axis of the drive stud. The face of the circular plate opposite the drive stud is provided with a concave shaped bevel gear while the outer periphery of the circular plate is provided with a plurality of ratchet teeth.

Spaced from the circular plate member is a semi-circular plate member pivotally secured to the wrench head and having a convex arcuate bevel gear around the outer periphery thereof. A spaced pair of pawl members are secured to either side of the semi-circular plate member and may be alternately engageable with the ratchet teeth of the circular plate member or may be centered to disengage the pawl members completely.

An elongated shaft is rotatably and slidably carried by the handle, the inner end extending into the wrench head adjacent the circular plate member and the outer end terminating with an external knurl knob to facilitate manual rotation of the shaft.

The inner end of the shaft is provided with a conical frustum-shaped bevel gear engageable with the circular plate member bevel gear when the shaft is in a withdrawn position.

A second conical frustum-shaped bevel gear is carried by the shaft, spaced from the first bevel gear and is engageable with the bevel gear of the semi-circular plate when the shaft is fully pushed into the wrench. The pivotal semi-circular plate and associated pawls will be referred to as a ratchet pawl switch.

A centering plate is carried by the shaft between the conical beveled gears and is engageable with a portion of the ratchet pawl switch such that when the shaft is withdrawn engaging the end bevel gear, the centering plate forces the switch plate to its center position thereby disengaging the pawl.

Hence, when it is desired to use the wrench as an ordinary ratchet wrench, the shaft is fully pushed into the wrench, engaging the second bevel gear with the pawl switch. The knob is rotated in one direction or the other to engage one of the pawls with the ratchet teeth of the circular plate.

On the other hand, in order to rotate the drive stud remotely without the ratchet action, the shaft is pulled out thereby engaging the end bevel gear and the circular plate bevel gear such that rotation of the shaft in either direction will effect rotation of the drive stud in that same direction.

Stated another way, clockwise rotation of the shaft produces clockwise rotation of the drive stud.

The shaft and wrench handle is provided with spring detent means to tend to hold the shaft in either the fully inserted or fully withdrawn positions.

The present invention provides a simple and efficient ratchet wrench having the dual features of ratchet action and easy rotation action, both being remotely controlled from the end of the handle.

DESCRIPTION OF THE DRAWINGS

Other and further advantageous features of the present invention will hereinafter more fully appear in connection with a detailed description of the drawings in which.

DETAILED DESCRIPTION OF THE PREFERRED EMBODIMENT

Figure 6:
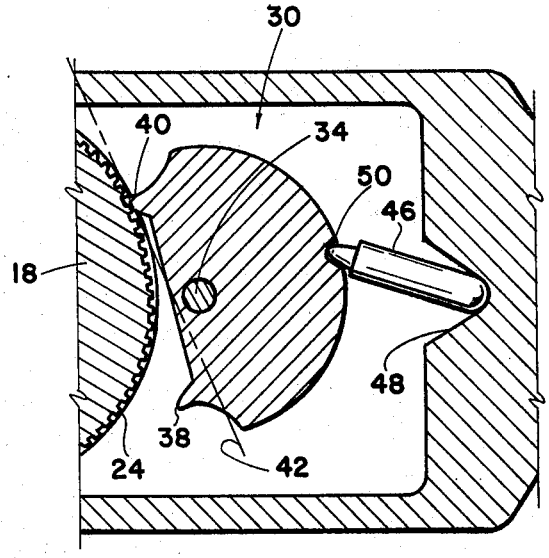
FIG. 6 is a partial sectional view of the ratchet pawl taken along the broken lines 6—6 of FIG. 5.

Referring to the drawings in detail, reference character 10 generally indicates a ratchet wrench embodying the present invention and comprising a ratchet head 12 having an elongated drive stud 14 rotatably mounted in the ratchet head for connection with ordinary stocket tools (not shown). The wrench also includes an elongated hollow handle member 16 which is attached to the ratchet head 12 or made as an integral part thereof and extends outwardly therefrom.

A circular plate member 18 is attached to the back of the drive stud 14 or can be made as an integral part thereof, the center line rotational axis of the plate 18 being coincidental with the rotational axis of the drive stud 14. The plate 18 is rotationally mounted in an aperture 20 of the drive head and is held in place by a suitable split ring 22 as shown in the drawings. The outer periphery of the circular plate member 18 is provided with a plurality of ratcheting teeth 24 for a purpose that will be hereinafter set forth. The inner face of the circular plate 18, opposite the drive stud 14, is provided with a concave-shaped circular bevel gear 26 which is in open communication with the hollow interior 28 of the ratchet head.

Figure 2:
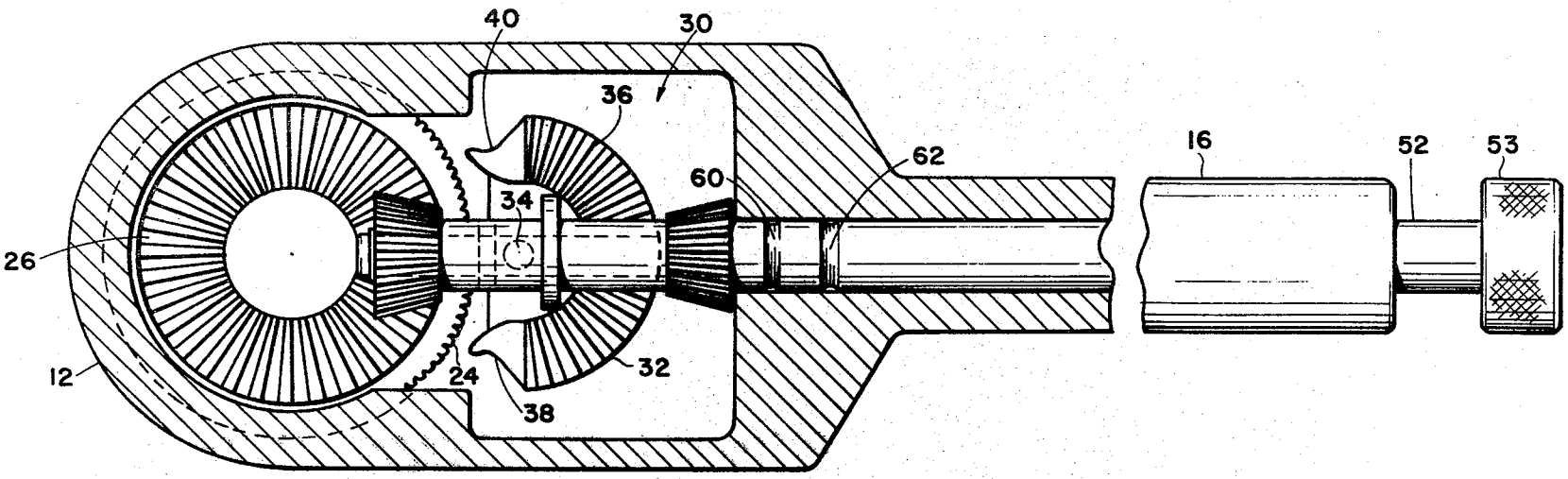
FIG. 2 is a sectional plan view of the wrench in FIG. 1.

Also located within the open interior 28 of the ratchet head 12 is a ratchet pawl switch generally indicated by reference character 30 and comprises a semi-circular plate member 32 which is pivotally secured to the ratchet head 12 by means of a pivot pin 34, the pivot pin 34 being parallel to the rotational axis of the drive stud. The outer semi-circular face of the plate 32 is provided with a convex arcuate bevel gear which will be referred to as a convex bevel gear 36. A pair of oppositely disposed outwardly extending pawl members 38 and 40 are secured to each side of the ratchet pawl switch adjacent the ends of the bevel gear and are positioned such that each said pawl member 38 and 40 may be alternately engageable with the ratchet teeth 24 of the circular plate member 18. Further, when the ratchet pawl switch 30 is centered as shown in FIG. 2, neither of the pawl members 38 or 40 are engaged with the ratchet teeth 24.

It is also noted by referring to FIG. 6 that when one of the pawls such as the pawl 40 is engaged with the ratchet teeth 24, a tangent line, as indicated by reference character 42 which is tangent to the circular plate member 18 at the point of contact with the pawl member 40, passes between the circular plate member 18 and the pivot point 34 of the ratchet pawl switch 30. This spacing of the pivot point 34 with respect to the ratchet teeth 24 allows the said circular plate member with the drive stud attached to rotate only in one direction when either pawl is engaged with the ratchet teeth 24 of the circular plate member 18.

Figure 3:
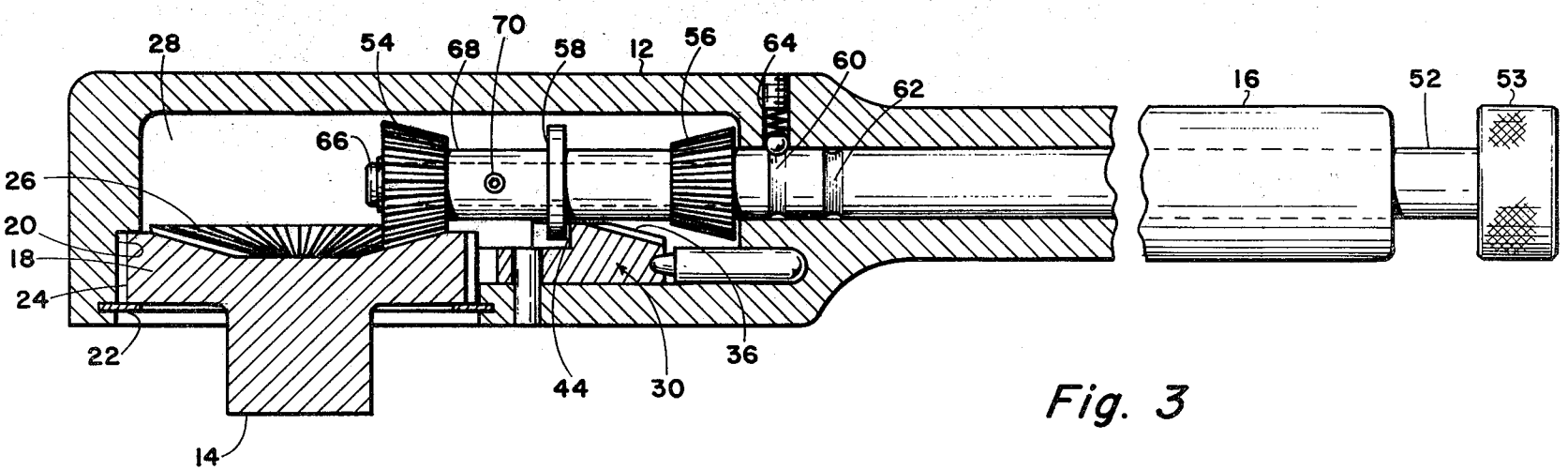
FIG. 3 is a sectional elevational view of the wrench of FIG. 1.
Figure 4:
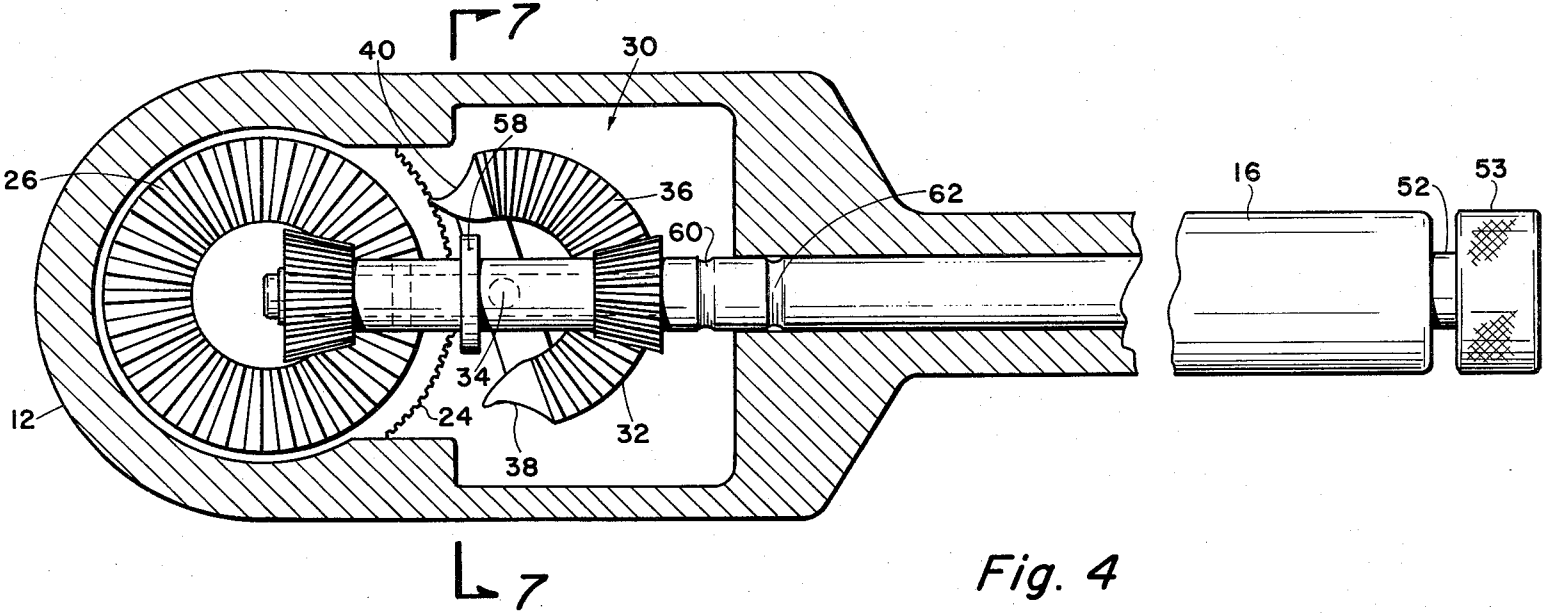
FIG. 4 is a sectional view similar to FIG. 2 showing the movement in an alternate position.

Referring now to FIG. 3, it is noted that the ratchet pawl switch 30 is further provided with a flattened portion 44 which, when the ratchet pawl switch is centered, the plane of the flattened portion 44 is perpendicular to the axis of the hollow handle member 16.

In order to urge the ratchet pawl switch in either one direction or the other, a suitable bullet-type compression spring member 46 is pivotally mounted within a recess 48 in the ratchet head near the handle attachment point and is likewise pivotally engaged in a suitable recess 50 provided in the ratched pawl switch 30.

An elongated rotatable shaft member 52 is rotatably and slidably journalled within the hollow handle member 16 and extends from the outside end of the handle member into the hollow space 28 of the ratchet head 12.

Figure 5:
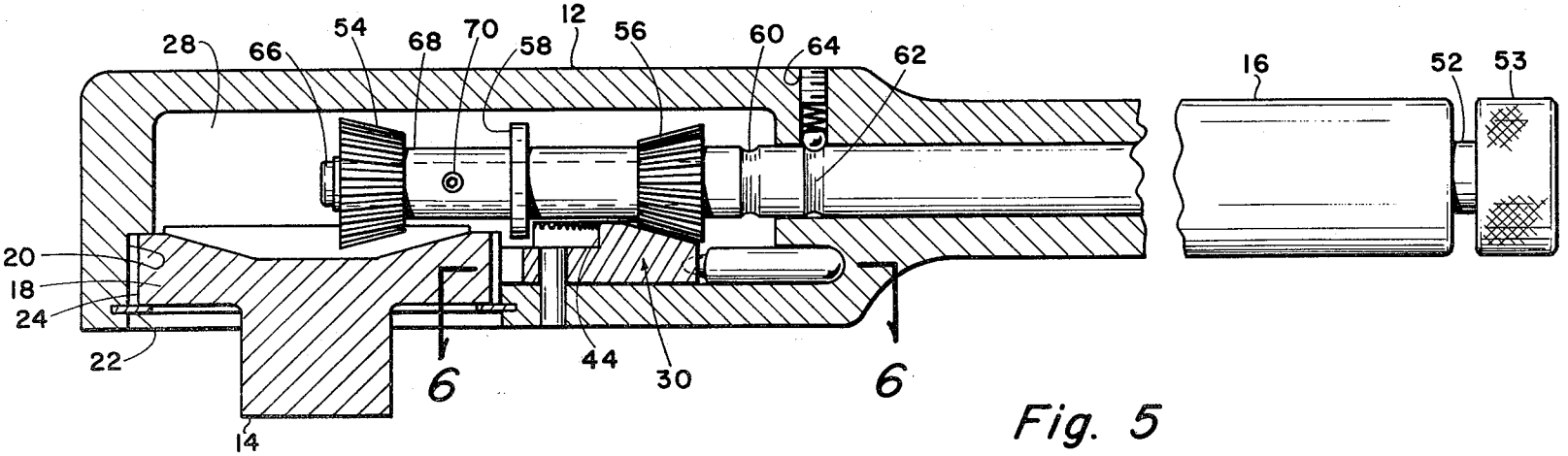
FIG. 5 is a sectional elevational view wrench of FIG. 4.

The inner end of the shaft 52 is provided with a conical frustrum-shaped bevel gear 54 which is engageable with the bevel gear 26 of the circular plate member 18 when the shaft 52 is withdrawn to its maximum extent as shown in FIG. 3. A second similar and oppositely disposed conical frustrum-shaped bevel gear 56 is carried by the shaft 52 and spaced from the bevel gear 54 such that the bevel gear 56 engages the ratched pawl switch bevel gear 36 when the shaft 52 is inserted to its fullest extent within the wrench as shown in FIG. 5. It is noted that only one of the bevel gears 54 or 56 may be engaged with the bevel gears inside the wrench head at any one position.

A circular plate member 58 is rigidly carried by the shaft 52 intermediate the bevel gears 54 and 56 and is positioned such that when the shaft 52 is fully withdrawn as shown in FIG. 3, the said plate member 58 will contact the flattened portion 44 of the ratchet pawl switch 30 thereby centering the pawl and disengaging them from the ratchet teeth 24.

The outer end of the shaft 52 is provided with a knurled knob 53 to facilitate manipulation of the shaft from the end of the handle.

The shaft 52 is also provided with a pair of spaced annular grooves 60 and 62 which are alternately engageable with a spring loaded ball detent 64 located in the ratchet head. When the shaft 52 is totally withdrawn as shown in FIG. 3, the ball detent is engaged with the groove 60 thereby tending to hold the shaft in that position while still allowing rotation thereof. Likewise, when the shaft is fully inserted within the wrench as shown in FIG. 5, the ball detent 64 is engaged with the groove 62 likewise tending to hold the shaft in that position while allowing rotation thereof.

As a practical matter, the shaft may be constructed as shown in FIG. 3 by having a reduced portion 66 at the inner end thereof. The bevel gears 54 and 56 along with the plate member 58 may then be mounted on a sleeve member 68 which can be secured to the reduced shaft portion 66 by means of a set screw 70. This arrangement will permit the wrench to be assembled through the aperture of the opening 20 in the wrench head so that the entire wrench body can be made of a single part.

Further as a practical matter, it may be necessary to make the ratchet head 12 of a split construction (not shown) for ease of manufacture.

In operation, if it is desirable to use the wrench as a typical ratchet wrench, the handle member 52 is fully inserted within the wrench as shown in FIG. 5 thereby engaging the bevel gear 56 on the shaft with the bevel gear 36 on the ratchet pawl switch 30. By use of the knob 53 the shaft may be rotated in either desired direction thereby either engaging the pawl 38 or the pawl 40 with the ratchet teeth 24. The wrench may be manipulated back and forth, the engaged pawl and ratchet teeth causing the drive stud to rotate in only one direction. Switching directions may be easily accomplished by simply rotating the shaft 52 to engage the opposite pawl.

On the other hand, when it is desired to operate the wrench on a loose nut or bolt for either tightening or loosening, the shaft member 52 is fully withdrawn as shown in FIG. 3 thereby engaging the bevel gear 54 on the end of the shaft with the concave circular bevel gear 26. The withdrawing of the shaft 52 also causes the plate member 58 to engage the flattened surface 44 of the pawl switch thereby centering the pawl switch and holding the pawls 38 and 40 out of engagement with the ratchet teeth 24.

The knob 53 may be then rotated in either direction thereby effecting a like rotation of the drive stud 14 through the meshed bevel gears.

Figure 8:
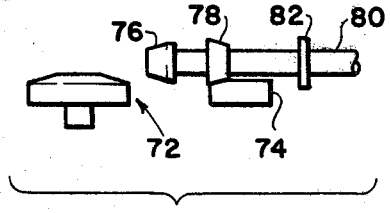
FIG. 8 is a schematic of an alternate embodiment.
Figure 7:
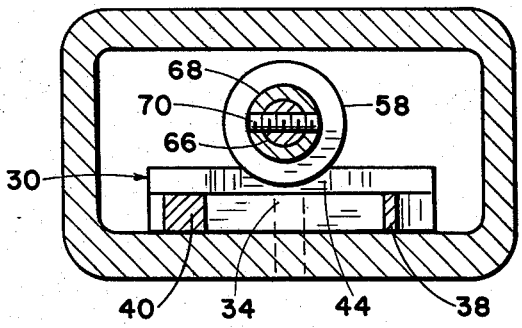
FIG. 7 is a partial sectional end view of the ratchet pawl taken along the broken lines 7—7 of FIG. 4.
Figure 1:
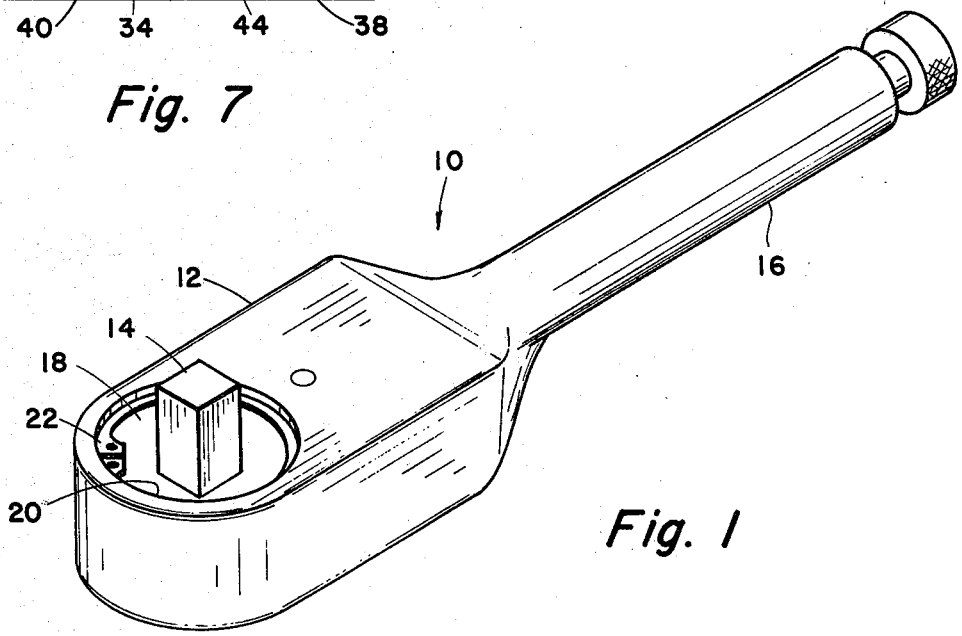
FIG. 1 is a prospective view of a ratchet wrench embodying the present invention.

Referring now to FIG. 8, an alternate schematic is shown having the bevel gears reversed from those shown and described in the previous drawings. In this case, the drive stud is connected to a circular plate having a convex bevel gear and indicated by reference character 72 while the ratchet pawl switch indicated by reference character 74 is reversed from that shown in the first embodiment. The bevel gears 76 and 78 carried by a shaft 80 are spaced apart and reversed in the manner shown in FIG. 8 while the centering plate 82 is on the opposite side of the pawl switch plate 74.

Therefore, when the shaft 80 is in a withdrawn position, the bevel gear 78 engages the bevel gear of the switch plate 74. Alternately when the shaft 80 is fully inserted within the wrench, the bevel gear 76 would engage the bevel gear 72 and the plate 82 would contact and center the pawl switch 74.

This schematic depicts an alternate way of accomplishing the invention as would straight gears as opposed to bevel gears (not shown). Therefore, it is understood that other and further modifications apart from those shown or suggested herein may be made within the spirit and scope of the invention.

What is claimed is:

1. An improvement in a ratchet wrench having selectable ratcheting action to rotate a drive stud in either direction, and an elongated handle member, the improvement comprising a three position ratchet pawl switch, a first position to effect ratcheting action in one direction, a second position to effect ratcheting action in the opposite direction, and third position to effect disengagement of the ratcheting action, means to rotate the drive stud in either direction when the ratchet pawl switch is in the third position, and remote control member disposed at the outer end of the handle member and operably connected with the ratchet pawl switch and the means to rotate the drive stud for remote manipulation of said ratchet pawl switch and for remote rotation of said drive stud when said ratchet pawl switch is in said third position.

2. An improvement in a ratchet wrench having a head member, an outwardly extending drive stud rotatably carried by the head member and an outwardly extending hollow handle member connected to the head member and disposed at a right angle to the drive head, the improvement comprising;

(a) a circular plate rotatably secured to the head member, the drive stud being attached thereto for rotation therewith, a plurality of ratchet teeth around the outer periphery of the circular plate, a circular gear rigidly secured to the circular plate opposite the drive stud;

(b) ratchet pawl switch member pivotally secured to the head member and spaced from the circular plate toward the handle member, a pair of spaced pawls carried by the switch member and disposed such that one pawl will engage the ratchet teeth when the switch member is pivoted in one direction, and the opposite pawl will engage the ratchet teeth when the switch member is fully pivoted in the opposite direction, and neither pawl will engage the ratchet teeth when the switch member is centered, an arcuate gear carried by the switch member, a switch centering device carried by the switch member;

(c) an elongated shaft rotatably carried by the hollow handle member and being also reciprocally disposed therein, a first gear member carried by the inner end of the shaft and being engageable with the circular gear when the shaft is in a first reciprocal position, a second gear member carried by the shaft and spaced from the first gear member and engageable with the arcuate gear when the shaft is in a second reciprocal position, a switch centering actuator carried by the shaft and engageable with the switch centering device when the shaft is in said first reciprocal position, external shaft rotating means carried by the outer end of the shaft.

3. A ratchet wrench as set forth in claim 2 wherein the circular gear is a bevel gear and the shaft first gear member is a compatible bevel gear.

4. A ratchet wrench as set forth in claim 2 wherein the arcuate gear is a bevel gear and the shaft second gear member is a compatible bevel gear.

5. A ratchet wrench as set forth in claim 2 wherein the switch centering device is a flat portion parallel to a line connecting the two pawls and the centering actuator is a circular disc having its plane perpendicular to the rotational axis of the shaft.

6. A ratchet wrench as set forth in claim 2 wherein the pawl switch member has a pivot point that is spaced toward the handle member from a line connecting the pawls and including yieldable means secured between the head member and the switch member and being capable of urging the switch member toward its fully pivotal positions in either direction.

* * * * *